US006128940A

United States Patent [19]

Song

[11] Patent Number: 6,128,940

[45] **Date of Patent: *Oct. 10, 2000**

[54] FOLDING SYSTEM FOR A CUTTING BLADE

[75] Inventor: Byung-Jun Song, Kwangmyung, Rep. of Korea

[73] Assignee: SDS USA, Inc., Northvale, N.J.

[ * ] Notice: This patent is subject to a terminal disclaimer.

[21] Appl. No.: 09/247,408

[22] Filed: Feb. 10, 1999

Related U.S. Application Data

[63] Continuation of application No. 09/049,391, Mar. 27, 1998, Pat. No. 5,870,919, which is a continuation of application No. 08/668,379, Jun. 21, 1996, Pat. No. 5,787,750.

[30] Foreign Application Priority Data

Jun. 22, 1995 [KR] Rep. of Korea ..... 95-16975

[51] Int. Cl.[7] ..... B21D 5/16

[52] U.S. Cl. ..... 72/294; 72/307; 72/319

[58] Field of Search ..... 72/307, 294, 306, 72/217, 388, 387, 319

[56] References Cited

U.S. PATENT DOCUMENTS

| | | | |
|---|---|---|---|
| 468,301 | 2/1892 | Cooper | 72/388 |
| 1,500,906 | 7/1924 | Thompson et al. . | |
| 1,834,733 | 12/1931 | Poole . | |
| 3,269,164 | 8/1966 | Rutter . | |
| 3,286,500 | 11/1966 | Weiss | 72/217 |
| 3,420,279 | 1/1969 | Tuit | 72/320 |
| 3,581,535 | 6/1971 | Hinks | 72/307 |
| 3,584,660 | 6/1971 | Paine | 72/307 |
| 3,731,513 | 5/1973 | Kindermann et al. | 72/295 |
| 3,823,749 | 7/1974 | Ritter | 72/307 |
| 3,874,976 | 4/1975 | MacFarland, Jr. | 72/342 |
| 3,958,440 | 5/1976 | Sassak | 72/307 |
| 4,002,049 | 1/1977 | Randolph, Sr. | 72/388 |
| 4,028,925 | 6/1977 | Mainiero | 72/294 |

(List continued on next page.)

FOREIGN PATENT DOCUMENTS

| | | |
|---|---|---|
| 0446819 | 9/1991 | European Pat. Off. . |
| 2723846 | 12/1977 | Germany . |
| 3433020 | 3/1986 | Germany . |
| 4103134 | 8/1992 | Germany . |
| 721163 | 3/1980 | Greece . |
| 54-27189 | 9/1979 | Japan . |
| 63-309328 | 12/1988 | Japan . |
| 220619 | 1/1990 | Japan . |
| 5329544 | 12/1993 | Japan . |
| 080607 | 12/1994 | Rep. of Korea . |
| 2116086 | 3/1982 | United Kingdom . |
| 2116086 | 9/1983 | United Kingdom . |

OTHER PUBLICATIONS

Defendant s First Amended Answer to Second Amended Complaint and Counterclaims.

Plaintiff s Reply to Defendant s First Amended Answer to Second Amended Complaint and Counterclaims, and Plaintiff s Counter–Counterclaims.

*Primary Examiner*—Daniel C. Crane

*Attorney, Agent, or Firm*—F. Chau & Associates, LLP

[57] ABSTRACT

The present invention provides an unified folding system for processing in one work line all working processes needed in cutting and folding a cutting blade in a shape suitable to a sheet matter molding. A cutting blade supplied from a transferring unit of the cutting blade is cut in a length suitable to a sheet matter molding configuration in a cutting molding unit adjacent thereto, simultaneously the cutting tip used in cutting is transferred together with the cutting blade to a folding device side through a guide member set which is to be contacted with the cutting molding unit, the cutting blade transferred to the folding device is folded in a predetermined shape by a folding member which performs a going-straight movement and a rotating movement, and thereby, at this time, the cutting tip is detached outside by a tare. Accordingly, a working efficiency and a productivity in the cutting and folding of the cutting blade are improved and increased.

19 Claims, 5 Drawing Sheets

U.S. PATENT DOCUMENTS

| | | | |
|---|---|---|---|
| 4,043,165 | 8/1977 | Badger et al. . | |
| 4,355,528 | 10/1982 | Rothenberger | 72/388 |
| 4,590,779 | 5/1986 | Stange et al. | 72/294 |
| 4,665,731 | 5/1987 | Yagi et al. | 72/307 |
| 4,681,210 | 7/1987 | Miki et al. | 72/307 |
| 4,718,265 | 1/1988 | Post | 72/217 |
| 4,723,431 | 2/1988 | McKindary | 72/173 |
| 4,782,684 | 11/1988 | Benton | 72/307 |
| 4,850,212 | 7/1989 | Frey | 72/173 |
| 4,890,469 | 1/1990 | Dischler | 72/387 |
| 4,989,429 | 2/1991 | Del Fabro et al. | 72/307 |
| 4,993,253 | 2/1991 | Del Fabro et al. | 72/307 |
| 4,996,866 | 3/1991 | Mesera et al. . | |
| 5,025,651 | 6/1991 | Del Fabro et al. | 72/294 |
| 5,099,669 | 3/1992 | Del Fabro | 72/307 |
| 5,195,348 | 3/1993 | Del Fabro et al. | 72/294 |
| 5,203,192 | 4/1993 | Kimura | 72/387 |
| 5,203,195 | 4/1993 | Ritter et al. | 72/387 |
| 5,341,669 | 8/1994 | Katz | 72/387 |
| 5,355,708 | 10/1994 | Kauffman | 72/294 |
| 5,461,893 | 10/1995 | Tyler | 72/294 |
| 5,463,890 | 11/1995 | Tachibana | 72/294 |
| 5,481,896 | 1/1996 | Yanagimoto | 72/307 |
| 5,495,741 | 3/1996 | Yamada | 72/387 |
| 5,499,522 | 3/1996 | Schwarze | 72/311 |
| 5,507,168 | 4/1996 | Mizsukawa et al. | 72/307 |
| 5,630,333 | 5/1997 | Yanagimoto . | |

FOLDING SYSTEM FOR A CUTTING BLADE

CROSS-REFERENCE TO RELATED APPLICATIONS

This is a continuation application of U.S. application Ser. No. 09/049,391, filed Mar. 27, 1998, now U.S. Pat. No. 5,870,919, which is a continuation of U.S. application Ser. No. 08/668,379, filed Jun. 21, 1996, now U.S. Pat. No. 5,787,750, which claims the benefit of Korean Application No 1995/16975, filed Jun. 22, 1995.

BACKGROUND OF THE INVENTION

1. Field of the Invention

The present invention relates to a folding system of a cutting blade used in forming a folding line on a sheet matter so that the sheet matter, such as paper or plastic, etc., may be made into a predetermined shape, and more particularly to a folding system of the cutting blade being used so that cutting and folding functions associated with the cutting blade can be performed in one process.

2. Description of the Related Art

Generally, the cutting blade is attached to a pattern for use in pressing a folding or a cutting line on plate matters such as paper, canvas, leather, plastic, etc. The plate matters with such pressed lines can be used in a folded shape like a box. Accordingly, in order to assemble and process the plate matter into a predetermined box shape with the cutting blade, it is necessary that the cutting blade is folded in a shape suitable to forming the processing line in the box shape.

Conventional art for the folding device of a cutting blade is disclosed, for example, in Japan Patent No. 1988-309328 and No. 1990-20619. In the conventional art, however, a folded member used as a cutting blade is constructed by a rotary body that converts only a straight line movement into an orthogonal direction against the folded member on an end part of the folded member, or performs only a revolving movement centered about one point. Therefore, a disadvantage along with the use of the prior art cutting blade assemblies is that the folded angle of a processed member is limited to a single range of motion. Also, since two discrete functions are required, namely after a cutting work in separated places, then moving it into a folding device individually, and then the folding work is performed, or after the folding work, then moving it into a cutting device one by one, and then the cutting work is performed, additional time and labor are required, and the overall efficiency of the process decreases.

SUMMARY OF THE INVENTION

Therefore, to solve the above problem, it is an object of the present invention to provide a system for folding a cutting blade to improve a work efficiency and a productivity, by continuously performing all work elements needed in the cutting and folding works of the cutting blade provided in a sheet matter molding, in one work line, the system comprising:

a transferring unit for transferring the cutting blade;

cutting means, situated between the transferring unit and a guide nozzle, for cutting the cutting blade, which is supplied from the transferring unit, in a length substantially corresponding to the sheet material molding configuration, wherein a cutting tip is formed on the cutting blade;

a guide member of a hollow shape, interposed the cutting means and a folding means and configured to connect the cutting means and the folding means, said guide member having a passage for guiding the cutting blade through the cutting means to the folding means;

folding means, supported such that it may be revolved and moved in a straight line direction to apply a force against the cutting blade passing through the guide member, the folding means positioned adjacent the guide member, and for folding the cutting blade to a predetermined angle, the folding means including at least two folding members;

first driving means configured to engage the folding means, for revolving and driving the folding means against the cutting blade; and second driving means configured to engage the folding means and move at least one of the folding members of the folding means to a position adjacent the cutting blade, prior to driving the first driving means.

BRIEF DESCRIPTION OF THE DRAWINGS

The preferred embodiments are described with reference to the drawings wherein.

DETAILED DESCRIPTION OF THE PREFERRED EMBODIMENT

A preferred embodiment of the present invention will be described below in more detail with reference to the accompanying drawings.

Figure 1:
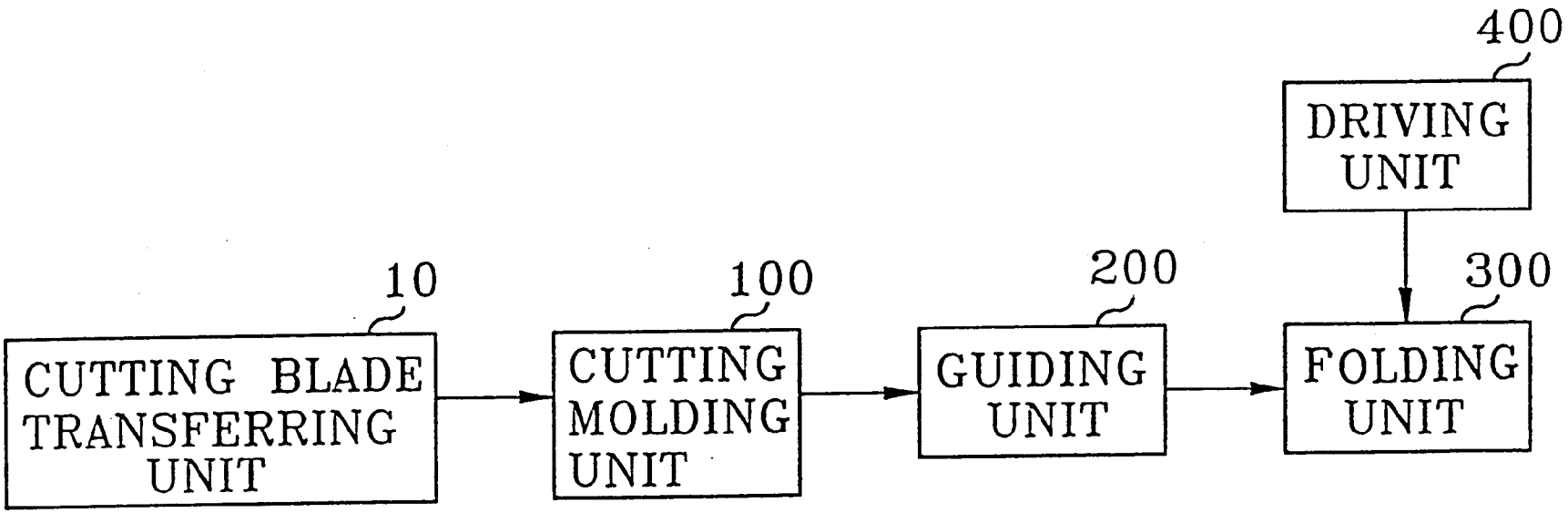
FIG. 1 is a block diagram for a folding system of a cutting blade according to the present invention.

FIG. 1 shows a block diagram of a folding system according to the present invention. In FIG. 1, the folding system of the cutting blade comprises a transferring unit 10 for transferring the cutting blade of a roll shape, a cutting molding unit 100 for cutting and processing the transferred cutting blade in a length suitable to a sheet material molding (not shown), a guiding unit 200, positioned between the cutting molding unit 100 and a folding unit 300 for the cutting blade so as to be connected mutually, for stably guiding the cutting blade which is passed through cutting molding unit 100 to folding unit 300, the folding unit 300 positioned adjacent to the guiding unit 200, for folding the cutting blade transferred through the guiding unit 200 with a predetermined angle, and a driving unit 400 for driving the folding unit 300 and thus a process work of the cutting blade provided to a sheet material molding is performed in succession. The detailed construction and operation of the above embodiment are explained below. The above cutting molding unit 100 is applied from Korean Patent No. 80607 entitled "Multi-purpose Cutter of a Cutting Blade for Die Cutter" filed by the present applicant on Dec. 11, 1991 and incorporated by reference herein. A detailed explanation for the cutting molding unit is therefore omitted below.

Figure 2:
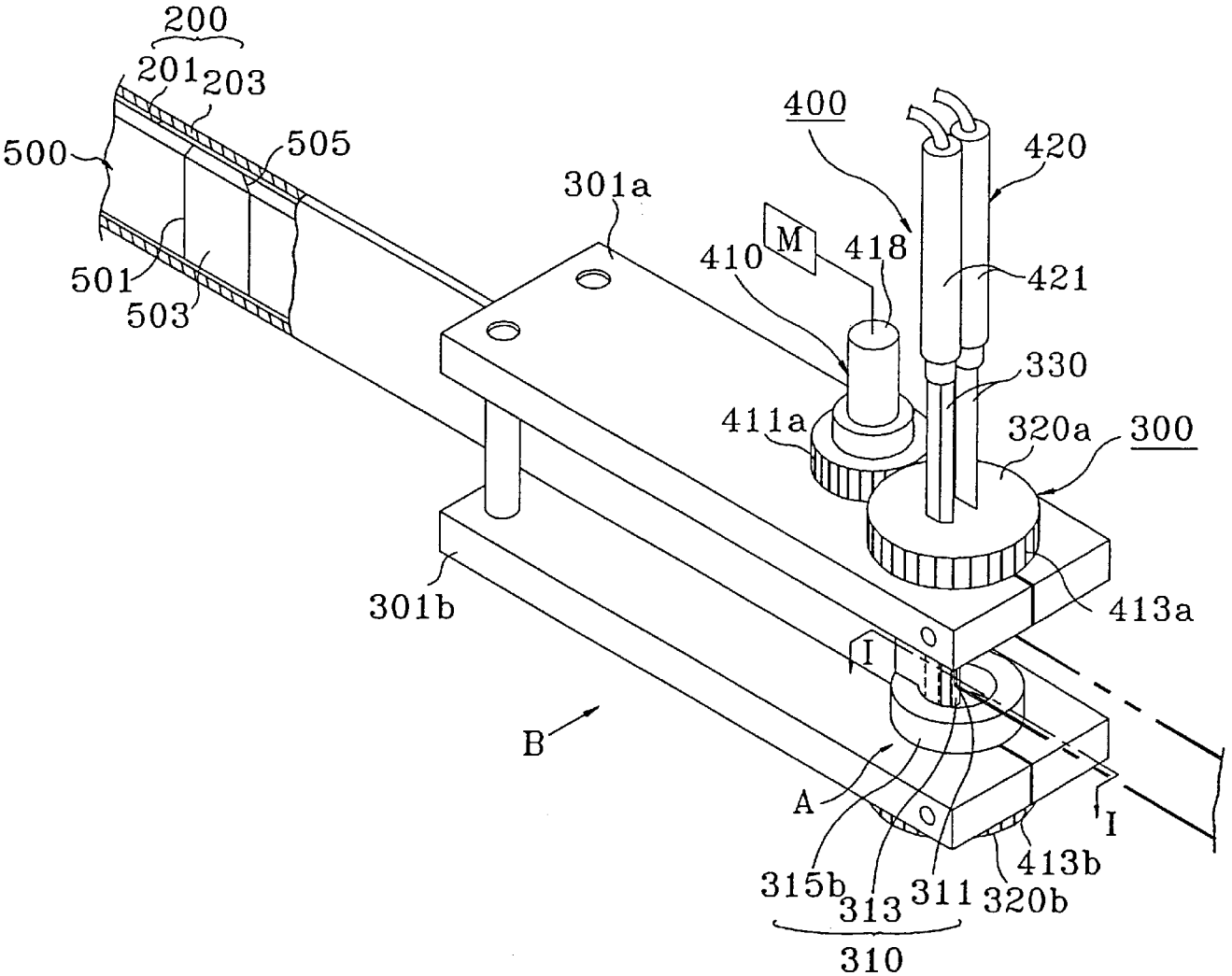
FIG. 2 is a detailed perspective view showing a guiding unit and a folding unit of the cutting blade shown in FIG. 1.
Figure 3:
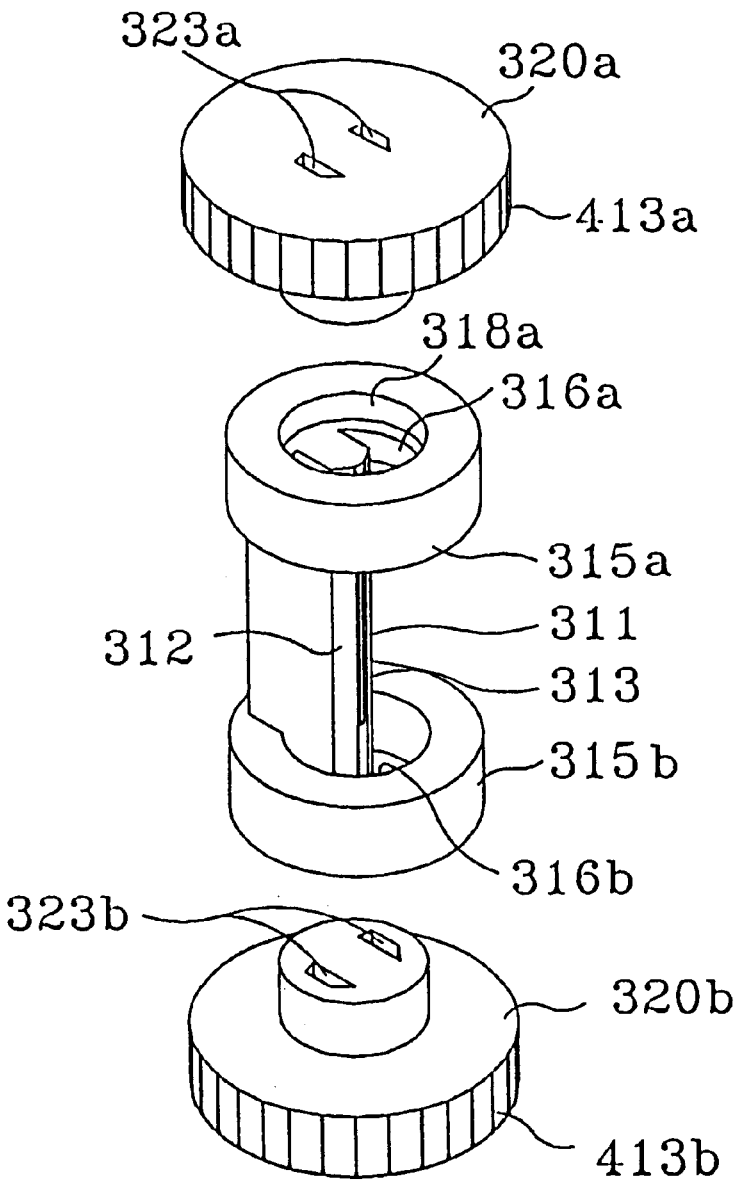
FIG. 3 is a separated perspective view showing a unit "A" separated from FIG. 2.
Figure 4:
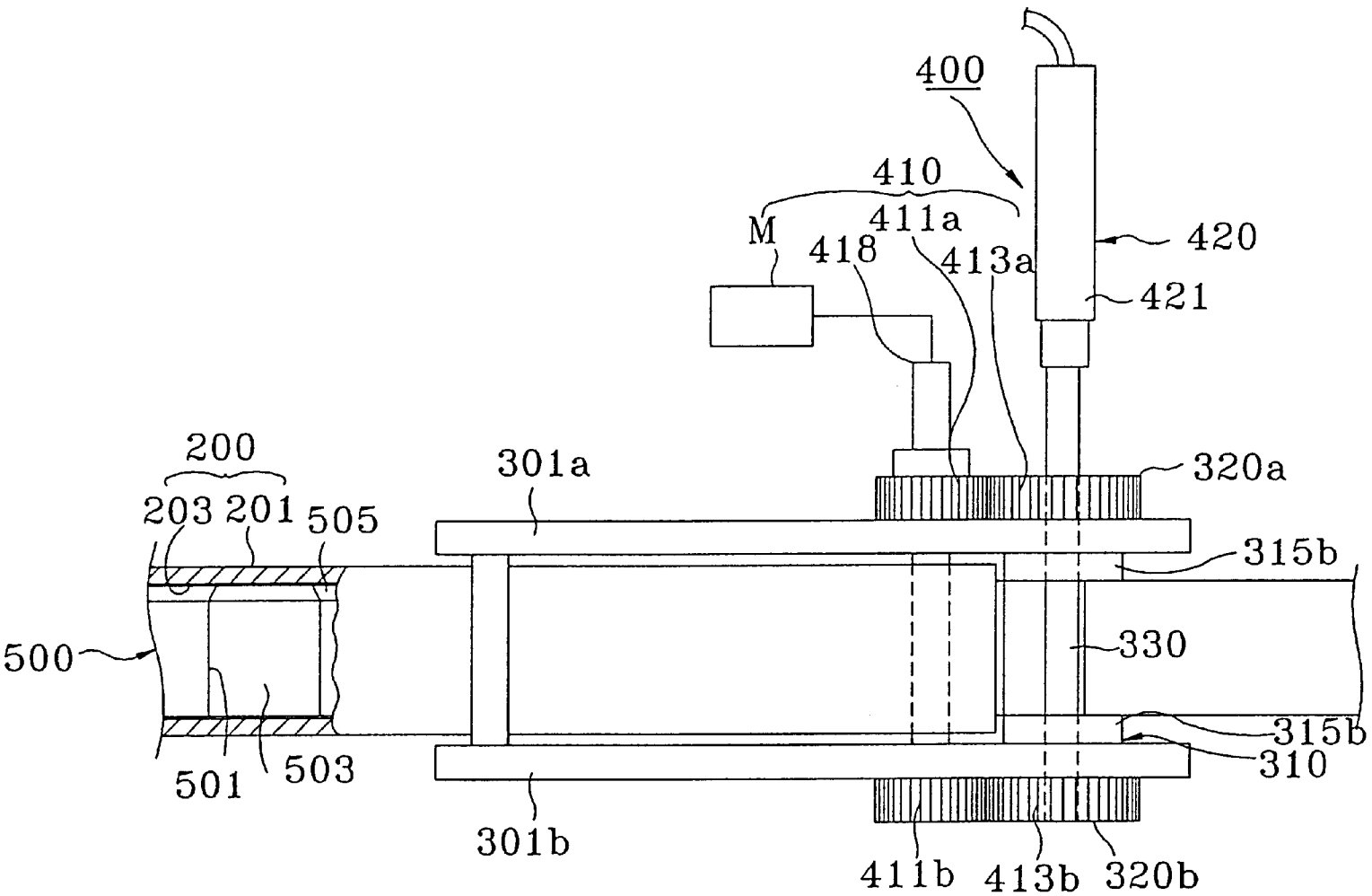
FIG. 4 is a side view shown from a direction "B" of an arrow marking of FIG. 2.

FIG. 2 is a detailed perspective view showing only a portion of the guiding unit associated with the cutting blade and the folding unit, shown schematically in FIG. 1. FIG. 3 is an exploded perspective view showing only a unit "A" separated from FIG. 2. FIG. 4 is a side view shown from a direction "B" of an arrow marking of FIG. 2. The guiding unit 200 is constructed by a guide nozzle 201 of a hollow structure configured and dimensioned to stably transfer a cutting blade 500 passed through the cutting molding unit to the folding unit 300.

Referring now to FIG. 2, guide nozzle 201 has a guiding passage 203 of a size such that cutting blade 500 can pass through freely, and two openings situated near the cutting molding unit 100 and the folding unit 300, respectively. The guide nozzle 201 is configured so that the cutting blade 500 may be moved together with a cutting tip 503 of a cutting portion 501.

Referring now to FIG. 3, folding unit 300 includes a fixing body 310 connected to folding and rotary bodies 320*a* and 320*b* for the folding, which are set on substantially rectangular shaped supporting frames 301*a* and 301*b*. The supporting frames 301*a* and 301*b* are situated spaced apart with an interval therebetween wherein the guide nozzle 201 can be situated. The fixing body 310 for the folding function is constructed by a folding body 313 having a guiding entrance 311 of a size through which the cutting blade 500 can be passed, and by annular support portions 315*a* and 315*b* formed on both ends of the folding body 313. The guiding entrance 311 of the folding body 313 is connected with the guiding passage 203 of the guide nozzle 201 such that the cutting blade 500 may enter inside the guiding entrance 311 freely. An end side portion of the guiding entrance 311 is preferably a slant side 312 to enhance the folding of the cutting blade 500.

Figure 6:
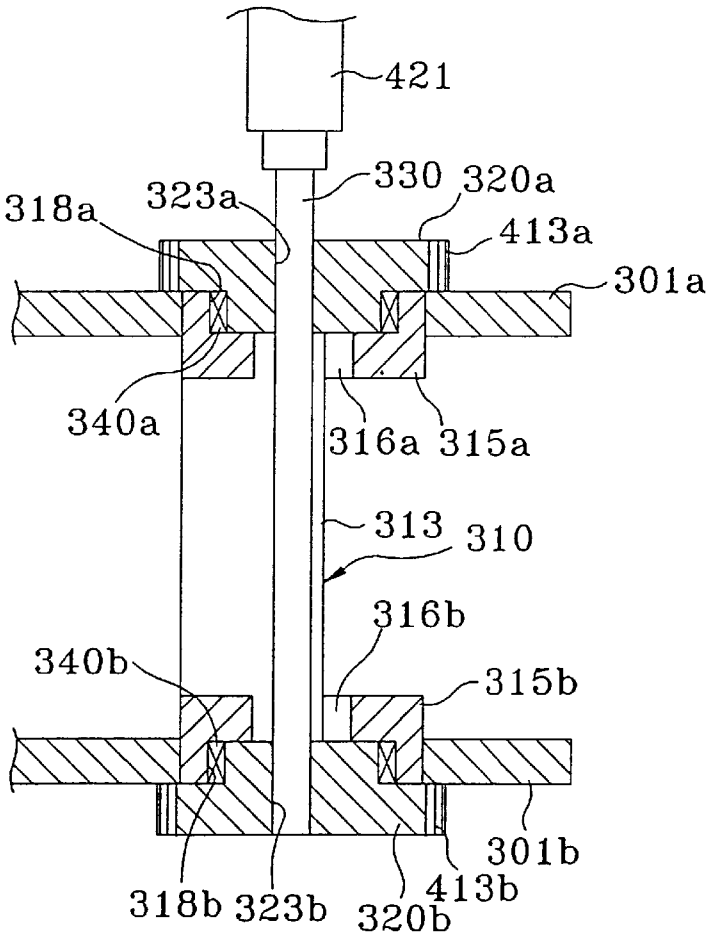
FIG. 6 is a longitudinal sectional view taken along a line II—II of FIG. 5.

The annular support portions 315*a* and 315*b* are provided to fixedly attach the folding body 313 to supporting frames 301*a* and 301*b*. As described later in FIG. 6 in detail, the annular support portions 315*a* and 315*b* include guiding slots 316*a* and 316*b* of a round shape, and round housing units 318*a* and 318*b* for housing rotary bodies 320*a* and 320*b* which may be rotated to facilitate the folding function. The rotary bodies 320*a* and 320*b* are configured to be rotatably housed within the round housing units 318*a* and 318*b* arranged on both sides of the fixing body 310. For a smooth revolving operation of the rotary bodies 320*a* and 320*b*, it is preferable to set bearings 340*a* and 340*b* on the inside circumference portion of the housing units 318*a* and 318*b*, as shown in FIG. 6. The rotary bodies 320*a* and 320*b* have guide holes 323*a* and 323*b* pierced therein and are configured to contact with the guide slots 316*a* and 316*b*.

The guide holes 323*a* and 323*b* are provided to insertably receive a folding member 330 to facilitate movement thereof, and are configured and dimensioned corresponding to a cross-sectional shape of the folding member 330. Although an example of the guide holes 323*a* and 323*b* is shown in the figures wherein each guide hole has a folding member set therein, it is preferable that only one folding member is set at a given time during operation. Referring now to FIG. 6, the folding member 330 is dimensioned to connect the rotary bodies 320*a* and 320*b* to each other while being positioned on the outer sides of supporting frames 301*a* and 301*b*. Accordingly, the folding member 330 is inserted through guide hole 323*a* of rotary body 320*a*passes through a lateral side of the fixing body 310, and is inserted into guide hole 323*b* inside of rotary body 320*b* and is capable of being moved upwards and downwards. The folding member 330 inserted for mutual connection of rotary bodies 320*a* and 320*b* is provided for the folding work of the cutting blade 500, revolving together with the rotary bodies 320*a* and 320*b*. When the folding work is not being performed, the folding member 330 is completely apart from folding body 313 and is moved towards an upper side. These operations are performed by the driving unit 400 mentioned later.

Although two folding members 330 are shown in the drawings, for exemplary purposes, only one can be set.

Referring now to FIGS. 2 and 4, driving unit 400 includes a first driving unit 410 provided to revolve the rotary bodies 320*a* and 320*b* and a second driving unit 420 provided to move folding member 330 upwards and downwards from the folding body 313. The first driving unit 410 includes first toothed portions 411*a* and 411*b* which are fixed at both ends of a rotating shaft 418 which is rotatably within the supporting frames 301*a* and 301*b*. Second toothed portions 413*a* and 413*b* which are set on the outer circumference surface of the revolving bodies 320*a* and 320*b* are configured to mesh with the first toothed portions 411*a* and 411*b*. A servo motor M is operatively connected to the rotating shaft 418. The second driving unit 420 is a cylinder 421 connected to one end of the folding member 330 to be moved upwards and downwards for the purpose of performing an expansion operation. As an operating source of the cylinder 421 any one of either oil-hydraulic pressure or air pressure can be used.

Figure 5:
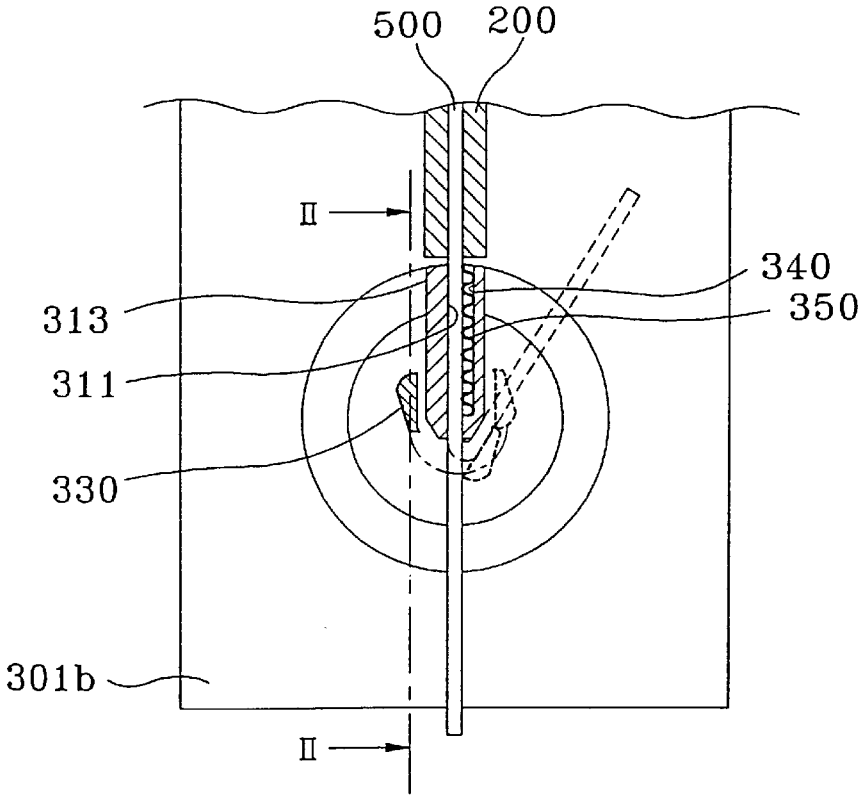
FIG. 5 is a cross-sectional view taken along a line I—I of FIG. 2.

FIG. 5 is a cross-sectional view taken along a line I—I of FIG. 2. FIG. 6 is a longitudinal sectional view taken along a line II—II of FIG. 5. Folding member 330 has a substantially triangular shape, which enables the cutting blade 500 to be folded easily even without applying an immoderate force. To fold the cutting blade 500 easily, an application of any other shape excepting the triangulate shape doesn't matter. On any one side of the guiding entrance 311 of the fixing body 313, which is supported to enable passing of the cutting blade 500, a fixation hole 340 is set. In the inside of the fixation hole 340, a steel wire spring 350 is set with one portion jutting out to a center position of the guiding entrance 311 through which the cutting blade 500 passes.

The steel wire spring 350 elastically supports the cutting blade 500 as it passes through the guiding entrance 311, and moves the cutting blade 500 within a predetermined channel, thereby heightening a precision of the folding work. Also, by setting a magnetic substance instead of the steel wire spring 350, the same effect as the steel wire spring can be achieved.

Though FIG. 5 shows, as an example, a structure in which the steel wire spring 350 is set on any one side of the guiding entrance 311, it is contemplated that it may be positioned on both sides. As shown in FIG. 6, the folding member 330 is extended when the cylinder 421 is driven, and is inserted into the guide holes 323*a* and 323*b* inside rotary bodies 320*a* and 320*b*which are formed in the housing units 318*a* and 318*b* of the round shape of the fixing body 310 for rotational movement therein. When the rotary bodies 320*a* and 320*b* are rotated, the folding member 330 is integrally rotated along the guide slots 316*a* and 3 16*b* together with the folding member 330.

An operation embodiment of the folding system and an effect according to the present invention with the construction as above-mentioned are re-explained in detail referring to FIGS. 1 to 6.

The cutting blade 500 wound in a roll shape is transferred to the folding unit 300, which performs the folding work, by the transferring unit 10, having a transfer roller, through the cutting molding unit 100 and the guide nozzle 201. At this time, the cutting molding unit 100 performs a cutting work for cutting the cutting blade 500, passing through the cutting molding unit 100, in the length necessary for the sheet matter molding. Herewith, the cutting tip. 503 is kept and maintained on the cutting blade 500 without detachment from the cutting portion 501 of the cutting blade 500. This is to prevent damage to blade unit 505 which may be caused by a collision during a transfer of the cutting blade 500 through the guide nozzle 201. The cutting molding unit 100 is applied from Korean Patent No. 80607 issued to the present applicant, and, therefore, the detailed operating description thereof is omitted.

Even if the cutting tip 503, formed on the cutting blade 500, is detached from the cutting molding unit 100, the cutting tip 503 passes through the guide nozzle 201 continuously and thereby there is no cause for its detachment. As shown in FIGS. 2 and 4, the cutting blade 500 passed through the guide nozzle 201 pierces through the guiding entrance 311 of the fixing body 313, and then goes out to the outer side of the supporting frames 301*a* and 301*b*.

The cutting blade 500 passing through the guiding entrance 311 contacts with the steel wire spring 350 as shown in FIG. 5, but the steel wire spring 350 has an elastic force, so it doesn't become an obstacle to pass the cutting blade 500 at all. The steel wire spring 3 50 is provided to support the cutting blade 500 with the elastic force to dampen or prevent a fluctuation in the cutting blade 500 which may be caused by a sudden stop of the transfer roller 10. The cutting blade 500 passed through the guiding entrance 311 is then folded in the shape suitable to a molding of the sheet material. In folding the cutting blade 500, the transfer roller 10 stops and the transferring work of the cutting blade 500 is temporarily in a stopped state. At the same time as the stop of the transfer roller 10, the second driving unit 420 between the driving units 400 operates first.

If only one cylinder 421 out of the second driving unit 420 falls in the operation, the second driving unit 420 remains situated in a position as shown in FIG. 2. The folding member 330 of one body with the cylinder 421 is inserted into the guide holes 323*a* and 323*b* inside of the rotary bodies 320*a* and 320*b* as shown in FIGS. 4 and 6, and is also situated on any one side of the fixing body 313 adjacent to the cutting blade 500. The guide holes 323*a* and 323*b* are formed on the same position, therefore the folding member 330 is inserted naturally when the cylinder 421 performs the falling operation. When the folding member 330 moved and is completed in moving to the position adjacent the cutting blade 500, the first driving unit 410 operates. The first driving unit 410 is rotated by driving the servo motor M. By driving the servo motor M, the first toothed portions 411*a* and 411*b* are simultaneously rotated by means of the rotating shaft 418. By a meshing operation between the first toothed portions 411*a* and 411*b* and the second toothed portions 413*a* and 413*b*, the revolving bodies 320*a* and 320*b* are rotated about a supporting point of the fixing body 310. When the revolving bodies 320*a* and 320*b* are rotated, the folding member 330 is also rotated. That is the folding member 330 is rotated and moved around a periphery of the fixing body 313 along the guide slot 316*b* from any one side of the fixing body 313 for the folding operation as shown in FIG. 5. At this time, the moved folding member 330 contacts with the cutting blade 500 which extends through the guiding entrance 311, thereby the cutting blade 500 is naturally folded by a rotating force of the folding member 330 along a slant face 312 of the fixing body 313. Meanwhile, the cutting tip 503 put on the cutting blade 500 is automatically separated by a tare and is collected when the cutting blade 500 extends through the outside of the guiding entrance 311.

Since the servo motor M stops the operation when the cutting blade 500 completes the folding, an immoderate rotation force of the rotary bodies 320*a* and 320*b* connected with the folding member 330 is not required. When the folding work of the cutting blade 500 is completed, the folding member 330 returns to an original position by an operation of the cylinder 421 of the second driving unit 420 as shown in FIG. 2. When the transfer roller 10 begins to operate again, the cutting blade 500 moves to the outer side of the guiding entrance 311 of the fixing body 313. While in that position, if a need exists to fold a predetermined unit of the cutting blade 500 in a direction opposite that which was described above, an operation of the transfer roller 10 stops, and at the same time the other folding member 330 falls and moves, and then the same steps as discussed above are repeated. As long as the cutting blade 500 is supplied, it may continuously be formed into any desired configuration. In the above-mentioned embodiment, though each step is explained separately for the understanding of the step for the folding work of the cutting blade, all processes such as a supply, a cutting, a folding work of the cutting blade, etc. can be performed by an automation controlled by a computer, etc.

As afore-mentioned, according to the present invention, all works necessary for the cutting and the folding of the cutting blade in the shape corresponding to the sheet material molding are performed in succession by one process with a unified construction, thereby resulting in an improvement of the cutting and folding works of the cutting blade and a productivity increase.

While only certain embodiments of the invention have been specifically described herein, it will apparent that numerous modifications may be made thereto without departing from the spirit and scope of the invention.

What is claimed is:

1. A metallic ribbon stock folding apparatus, comprising:

a guide having a passage for passing ribbon stock, said passage defining a longitudinal plane;

an elongate member mounted for movement in a direction substantially transverse to said longitudinal plane between a retracted position and an extended position; and a rotary assembly having first and second rotary bodies spaced to retrieve ribbon stock therebetween, said elongate member engaging both first and second rotary bodies when in the extended position, said rotary assembly configured for arcuate motion relative to said guide to move said elongate member from a first position toward at least one second position to fold a portion of said ribbon stock.

2. The metallic ribbon stock folding apparatus as recited in claim 1, wherein said longitudinal plane is defined by a first side and a second side opposite said first side relative to said longitudinal plane and said elongate member can be sequentially positioned on said first and second sides of said longitudinal plane.

3. The metallic ribbon stock folding apparatus as recited in claim 1, comprising two elongate members.

4. The metallic ribbon stock folding apparatus as recited in claim 1, wherein said elongate member has a substantially trapezoidal cross-section.

5. The metallic ribbon stock folding apparatus as recited in claim 4, where the elongate member has a stock engaging edge formed by the intersection of at least two sides of the substantially trapezoidal cross-section.

6. The metallic ribbon stock folding apparatus as recited in claim 1, wherein the elongate member contacts ribbon stock for folding ribbon stock in a direction which is substantially orthogonal to said longitudinal plane.

7. The metallic ribbon stock folding apparatus as recited in claim 1, wherein said metallic ribbon stock is a cutting blade.

8. A method of folding metallic ribbon stock, comprising the steps of:

transferring ribbon stock through a passage formed by a guide, said passage defining a longitudinal axis;

providing at least one retractable elongate member;

moving said elongate member between a disengaged position when it is retracted and an engaged position when it is extended relative to the guide;

providing at least one rotary assembly having first and second rotary bodies spaced to receive ribbon stock therebetween;

engaging both first and second rotary bodies with said elongate member when said elongate member is extended in the engaged position; and rotating said rotary assembly in an arcuate motion relative to said guide from a first position toward at least one second position to fold a portion of ribbon stock.

9. The method of folding metallic ribbon stock as recited in claim 8, further comprising the steps of:

disengaging said elongate member from the first rotary body and engaging both said first and second rotary bodies at a third position, said third position being different from said first position; and moving said elongate member from a third to a fourth position to fold a second portion of said ribbon stock.

10. The method of folding metallic ribbon stock as recited in claim 8, wherein said guide defines a longitudinal plane having a first side and a second side opposite said first side relative to said plane, the method further comprising the step of:

sequentially positioning the elongate member on said first and second sides of said longitudinal plane.

11. The method of folding metallic ribbon stock as recited in claim 8, further comprising the step of:

contacting the ribbon stock with a stock engaging edge formed on the elongate member and folding said ribbon stock in a direction which is substantially transverse to said longitudinal axis.

12. A system for folding a metallic ribbon stock in a shape conforming to a desired sheet material molding configuration, the system comprising:

a transferring unit for transferring the ribbon stock;

a guide member having a passage for guiding the ribbon stock during transfer by the transferring unit;

folding means, supported such that it may be revolved and moved in a straight line direction for applying a force against the ribbon stock passing through the guide member, the folding means positioned adjacent said guide member, and for folding the ribbon stock to a predetermined angle;

first driving means configured to engage said folding means, for revolving and driving the folding means against the ribbon stock;

second driving means configured to engage and move said folding means to a position adjacent the ribbon stock;

wherein said folding means comprises a supporting frame comprised of at least two plate shaped members, the guide member positioned between the at least two plate shaped members; a fixing body having a predetermined length and a guide entrance operatively connected with said guide member, wherein ends of the fixing body are rotatably fixed to the supporting frame, the fixing body having a guide slot formed therein for insertably receiving said folding means, and a pair of rotary bodies, rotatably connected to the ends of the fixing body for revolving the folding means, said pair of rotary bodies having a pair of guide holes formed therein for insertably receiving the folding means.

13. The system of claim 12, wherein the folding means have a substantially triangular cross-section.

14. The system of claim 12, wherein said guide entrance further comprises supporting means for moving the ribbon stock in a predetermined channel.

15. The system of claim 14, wherein said supporting means comprises a magnetic substance.

16. The system of claim 12, wherein said first driving means comprises:

a first toothed portion set on the pair of rotary bodies;

a second toothed portion set on both ends of a rotating shaft installed on the supporting frame, the second toothed portion configured to mesh with the first toothed portion; and a servo motor coupled to the rotating shaft for rotating the rotating shaft.

17. The system of claim 12, wherein said second driving means comprises a cylinder, direct-connected to the folding means, for moving the folding means into and out of engagement with the pair of rotary bodies.

18. The system of claim 12, further comprising cutting means for cutting the ribbon stock supplied from said transferring unit in a length substantially corresponding to the sheet material molding configuration.

19. The system of claim 12, wherein the folding means are configured and dimensioned for connecting said pair of rotary bodies to each other through the guide holes of the pair of rotary bodies and the guide slots of the fixing body.

* * * * *